United States Patent [19]

Gazzarrini

[11] 4,308,980

[45] Jan. 5, 1982

[54] POSITIONING DEVICE FOR TUBULAR HOSE

[75] Inventor: Vinicio Gazzarrini, Tavarnuzze, Italy

[73] Assignee: Solis S.r.l., Tanarnuzze, Italy

[21] Appl. No.: 119,130

[22] Filed: Feb. 6, 1980

[30] Foreign Application Priority Data

Feb. 7, 1979 [IT] Italy ..... 9339 A/79

[51] Int. Cl.[3] ..... A41H 43/00; D05B 21/00

[52] U.S. Cl. ..... 223/43; 112/121.15

[58] Field of Search ..... 223/39, 40, 43; 112/121.15

[56] References Cited

U.S. PATENT DOCUMENTS

| | | | |
|---|---|---|---|
| 3,420,196 | 1/1969 | Edwards et al. | 223/43 X |
| 3,486,471 | 12/1969 | De Spain | 112/121.15 |
| 3,875,880 | 4/1975 | Hazelgrove et al. | 112/121.15 |
| 3,941,069 | 3/1976 | Fukuyama | 112/121.15 X |
| 3,941,285 | 3/1976 | Bailey | 223/43 |
| 4,133,277 | 1/1979 | Arthur et al. | 112/121.15 |
| 4,196,681 | 4/1980 | Chietti | 112/121.15 |

FOREIGN PATENT DOCUMENTS

| | | | |
|---|---|---|---|
| 1396007 | 3/1965 | France | 223/43 |
| 1441188 | 6/1976 | United Kingdom | 112/121.15 |

*Primary Examiner*—Louis Rimrodt

*Attorney, Agent, or Firm*—McAulay, Fields, Fisher, Goldstein & Nissen

[57] ABSTRACT

A device for automatic positioning of the tip of a tubular stocking which is to be sewn together with the heel portion onto a pneumatic inverter tube which has an open mouth, the stocking being provided with an indexing mark thereon, the device includes a stocking support which is axially rotatable relative to the inverter tube and is disposed substantially coaxially and an indexer responsive to the indexing mark on the stocking to activate a control to hold the stocking over the tubular support to assure proper orientation of the stocking for sewing.

7 Claims, 6 Drawing Figures

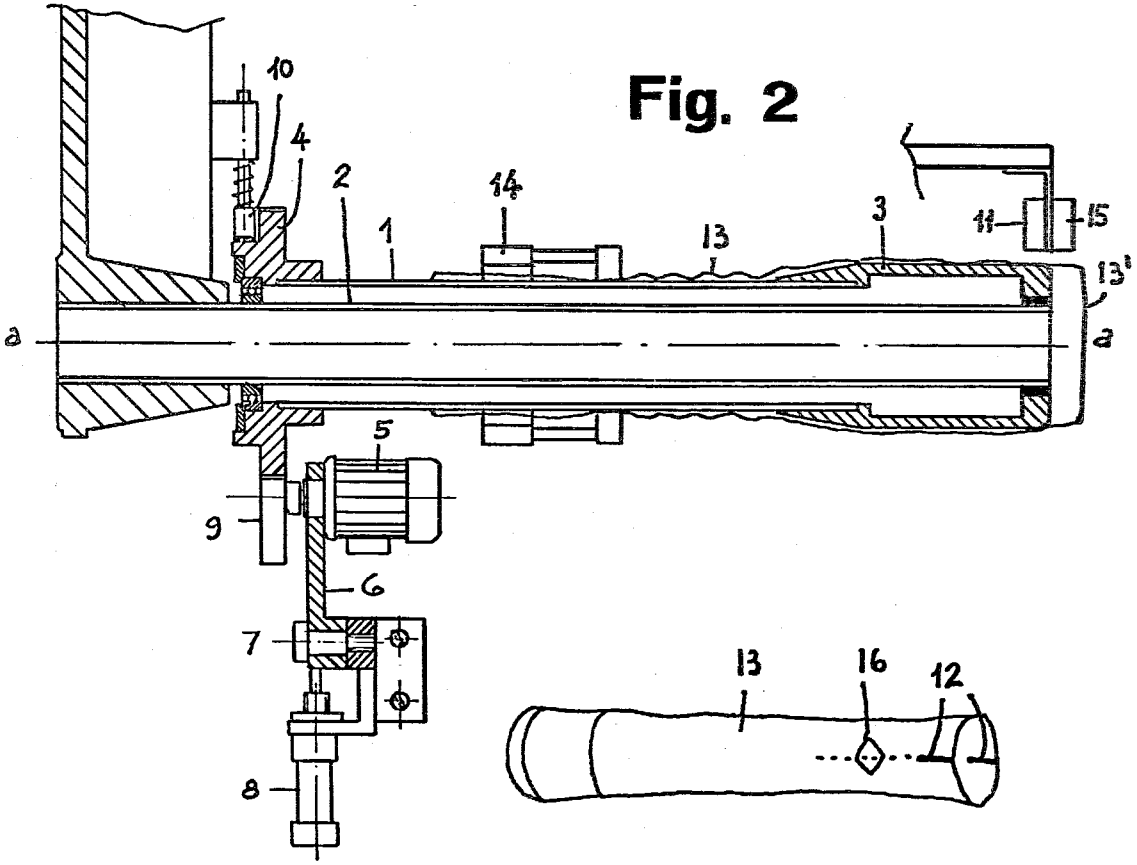
Fig. 2
Fig. 1
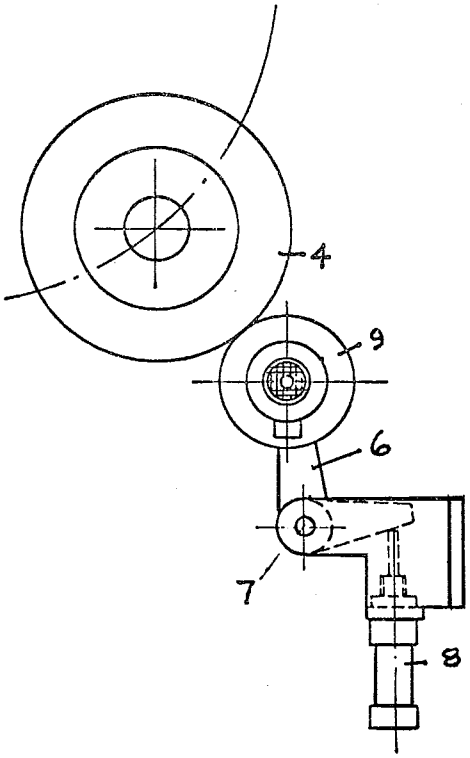
Fig. 3

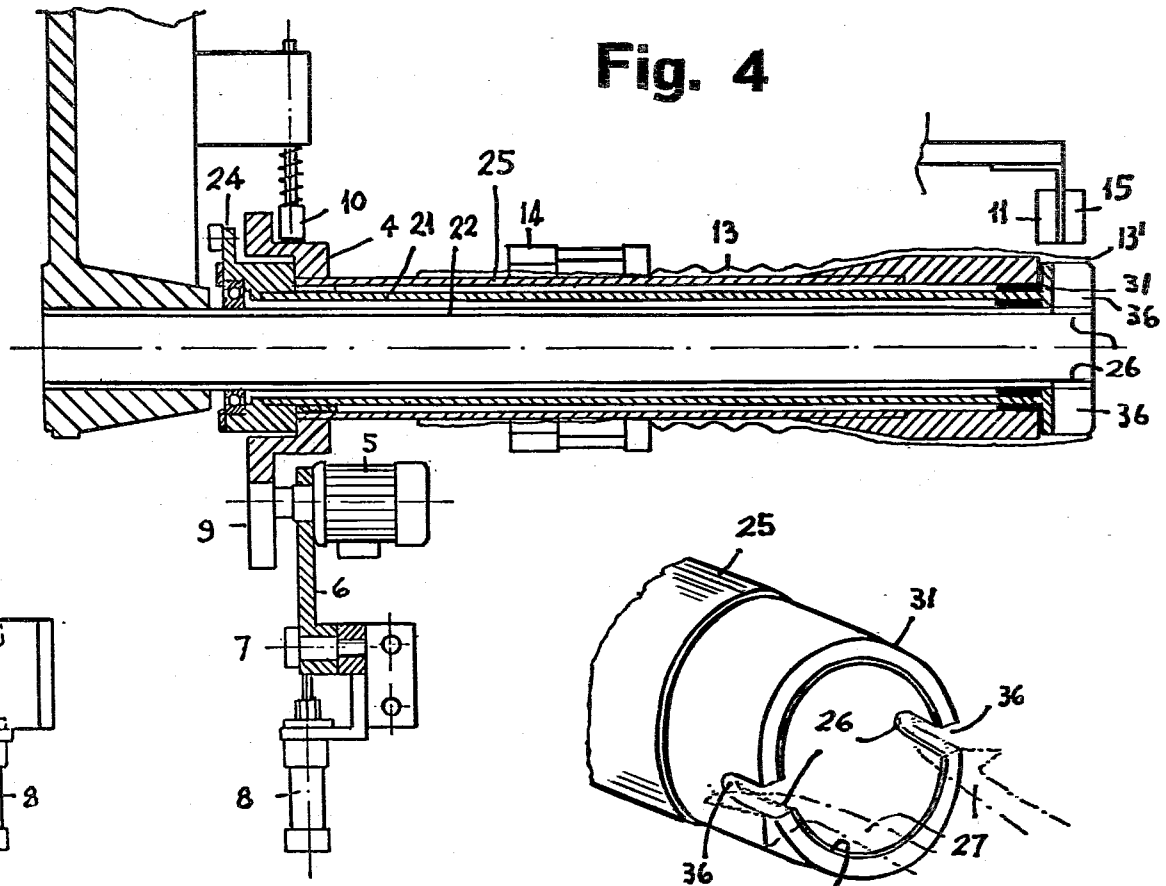
Fig. 4
Fig. 6
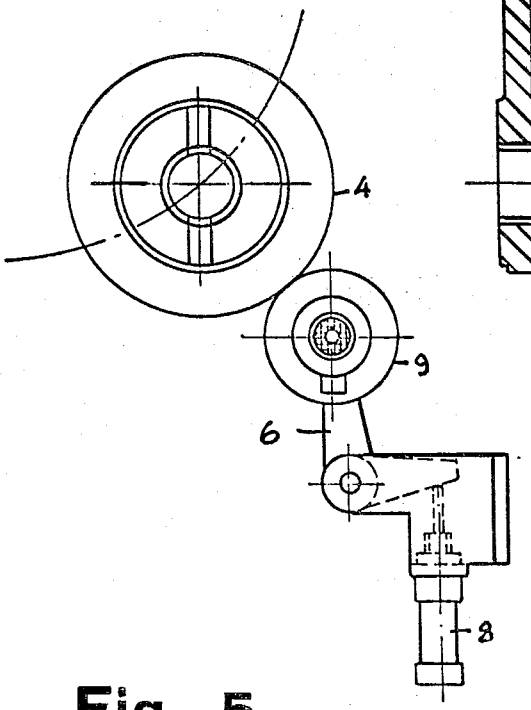
Fig. 5

POSITIONING DEVICE FOR TUBULAR HOSE

BACKGROUND OF THE INVENTION

The present invention relates to a means for sewing closed the toe portion of a tubular hosiery item, to complete or finish the item.

Women's hosiery items are made both with and without a heel portion formed thereon. Essentially, the hosiery item includes a tubular article in the form of a stocking which has one end sewn to form the toe portion. When the hosiery item is made without a heel, automatic sewing of the toe portion or tip may be accomplished by disposing the tubular article over an appropriate support. This support is preferably a usual pneumatic inverter apparatus having multiple tubular supports. However, the tubular article does not fit closely on the tubular support. The hosiery item or stocking so held can have its toe portion closed by automatic sewing devices. On the other hand, the present method of sewing the open tip portion of a stocking when a heel is applied is not automatic. Because the toe portion of the hosiery item or stocking must be sewed in a very definite and particular position relative to the heel portion, the manipulation of the stocking to ensure that the sewing machine operates in a proper manner is still done by hand. Moreover, since there is a need for manual manipulation of the hosiery item or stocking to ensure that the sewing thereof is correct with respect to the placement of the heel, the production of stockings or other hosiery items provided with a heel is much more complex than the production methods for stockings or other hosiery items without a heel, and the quality of the product with the heel is usually inferior to that without the heel.

BRIEF DESCRIPTION OF THE INVENTION

It is therefore an object of the present invention to overcome the aforesaid difficulties by providing an automatic positioning device for a tubular hosiery item which is to be provided with a heel.

A further object of the invention is to provide an automatic positioning device for the tubular hosiery item provided with a heel for assuring the positioning and holding of the tubular hosiery item onto a pneumatic inverter support apparatus to assure the automatic sewing of the tip of the hose to form the toe portion thereof.

In order to accomplish mechanically and automatically the sewing of the tip of stockings with a heel on a sewing machine provided with a pneumatic inverter apparatus it becomes necessary, after the tubular article has been mounted on the tube support, to position the end to be sewn in a predetermined position relative thereto. That is, the stocking must be supported on a support tube which is mantained in a predetermined relationship with respect to the applied heel portion, before the end to be sewn is taken out of the means for transfer of the stocking to the sewing machine. This ensures that once the end to be sewn has been transported to the sewing means, the heel will be in the proper position relative to the stitch line for the toe.

Briefly, the objects of the invention are achieved by applying one or two marks, e.g. in the form of a thread of darker color than the yarn with which the fabric is made, suitably disposed relative to the heel in the fabric forming the end to be sewn. The stocking is then loosely mounted onto the tube of the pneumatic inverter and rotated about its own axis until the heel is relative to the tube of the pneumatic inverter in the position brought about by the position of the marks relative to the heel and the elements displaying them. A light detector such as a photocell may be used to determine when the relative positioning of the stocking and support are as desired to provide for the proper positioning of the heel. Advantages and characteristics of the invention will be better understood by one skilled in the art with reference to the description which follows and to the accompanying drawings, showing two embodiments of the invention.

BRIEF DESCRIPTION OF THE DRAWINGS

In the drawings:

FIG. 1 is an isometric overall view of a tubular stocking with heel in whose fabric, are provided, two longitudinal, diametrically opposite marks at the end to be sewn, one of the marks being on the prolongation of the longitudinal axis of the heel, the stocking thus being adapted to be used with a device according to the invention;

FIG. 2 is a plan view, in section along the horizontal diametric plane, of a combination comprising a pneumatic inverting tube and a device according to the invention on which a stocking with heel is in position for sewing the tip;

FIG. 3 is a left side view of the group of FIG. 2;

FIG. 4 is a plan view, in section along the horizontal diametrical plane similar to FIG. 2 but with a modified device according to the invention;

FIG. 5 is a left side view of the group of FIG. 4;

FIG. 6 is an isometric view of the detail of the mouth of the device according to FIG. 4.

DESCRIPTION OF THE PREFERRED EMBODIMENT

Reduced to the essential structure and according to the preferred embodiment of FIGS. 1–3, a device according to the invention comprises: a tubular support 1 mounted loosely on a pneumatic inverter tube 2 of horizontal axis. Tubular support 1 is provided near the mouth thereof with an end portion 3 with an enlarged diameter to stretch the portion of the stocking 13 (FIG. 1) disposed thereover. A knurled wheel 4 is fastened to support 1 at the end thereof opposite to mouth 3 and coaxial to inverter tube 2. Disposed below this arrangement is a motor group for driving and controlling the vertical rotation of wheel 4. The motor group or assembly includes a continuously operated electric motor 5 having a roller 9 secured for rotation with an output shaft of the motor. Motor 5 is also mounted on a bracket 6, which bracket 6 is pivotally mounted for oscillating movement about a horizontal axis 7 parallel to the central axis (a; a) of the inverter tube 2. Bracket 6 is moved by a driving member such as pneumatic device 8 (FIG. 3) to obtain intermittent contact between the roller 9 integral with the shaft of the electric motor 5 and the knurled wheel 4. A braking friction element 10 continuously acts on the wheel 4 with braking effect on the support 1 at the moment of detachment of the roller 9 from the knurled wheel 4 (FIG. 2). A device e.g. with photo-cell, is mounted near the enlarged portion 3 at the end of support 1 for detection of the marks 12 provided in the fabric of the tubular stocking 13 mounted on the element 1.

The operation of the above-described embodiment is as follows: The stocking 13 is disposed loosely over onto the tubular support 1 as is commonly done on a tube of an ordinary pneumatic inverter. The positioning of the stocking 13 is then controlled by a collar or collet device 14 of known type, in cooperation with a sighting member 15 of known type, as for example with a photocell device 11. First, the end of the stocking to be sewn is moved back until its free edge 13' reaches a predetermined position slightly projecting from the mouth of the support 1 while yet maintaining a cylindrical position owing to the absence of an appreciable constriction of said edge 13' once off of the support 1. Then the sighting device 15 activates the control member 8 driving the roller 9 into contact with the knurled wheel 4, thereby producing a vertical rotation of the tubular element 1 until one of the marks 12 is detected by the detection device 11. When one of the marks 12 is detected, detection device 11 generates a signal that deactivates member 8 and thereby moves roller 9 out of contact with knurled wheel 4. When wheel 4 is no longer driven, braking element 10 operates to stop rotation of wheel 4, then rotation of tubular support 1 and hence rotation of stocking 13 is also stopped. Since the marks 12 are in fixed relationship to the stocking and the heel portion 16, heel 16 is placed into a predetermined position for the sewing of the tip of the stocking.

A further preferred embodiment of the device according to the invention is provided for stockings whose free edge 13' constricts when it is pushed free over the mouth of the tubular support 1. This is due to the nature of the fabric and the particular yarns with which it is made. This causes the stocking to prevent any slippage taking place between the support 1 and the stocking 13 when the stocking is moved by the collet 14, for transporting the stocking to the sewing means or positioning the stocking end 13' which is to be sewn at the sewing means.

Reduced to the essential structure and with reference to (FIGS. 4–6), such a device comprises: A tubular element 21 loosely mounted on tube 22 of the pneumatic inverter. At the mouth of said tube 22 two longitudinal diametrically opposite slots 26 are provided for the horizontal passage of a known gripping means 27 for gripping the end to be sewn of the stocking 13. The mouth of said tubular element 21 is defined by a head 31 mounted loosely and coaxially with the slotted end of said inverter 22 and likewise provided withtwo longitudinal slots 36 juxtaposed to the ones 26 of the inverter tube 22. A lever 24 is fastened to the tubular element 21 at the end opposite the mouth and in radial direction relative to the inverter tube 22. Lever 24 operating by known means, causes vertical rotation of said tubular element 21 with respect to inverter tube 22 by just enough to cover the slots 26 of the inverter tube 22 prior to the mounting of the stocking on the support 25 and subsequently to bare them, prior to the transfer of the tip 13' to be sewn. A tubular support 25 is mounted loosely on the tubular element 21, and entirely identical to the tubular support 1 of FIG. 1 and whose operation is also identical to the support 1 of the previous form of the invention.

In practice, the details of operation can vary in equivalent manner as to form, dimensions, arrangement, nature of the materials used, without going outside the scope of the idea of solution adapted and therefore remaining within the limits of the protection granted by the present patent for industrial invention.

I claim:

1. A device for automatic positioning of the tip of a tubular stocking which is to be sewn together with the heel portion thereof onto a pneumatic inverter tube having an open mouth forming part of a pneumatic inverter of a machine for sewing stocking tips, the stocking having an indexing mark thereon, comprising in combination:

a rotatable tubular stocking support disposed substantially coaxially with and loosely around said inverter tube whereby said tubular support is axially rotatable with respect to said inverter tube;

drive means operable to rotate said tubular support;

control means operable to control the operation of said rotating means in response to a control signal; and, index responsive means connected to said control means and operable to generate the control signal for said control means in response to a predetermined relative positioning of the indexing mark on the stocking to move and to hold a stocking disposed over said tubular support in the predetermined relative position whereby the stocking will be properly oriented for sewing.

2. The device of claim 1, wherein said tubular support has an enlarged outer diameter mouth portion coplanar with the open mouth of said inverter tube.

3. The device of claim 1, wherein said drive means comprises:

a wheel mounted on and coaxial with said tubular support;

motor means for intermittently driving said wheel; and, braking means for applying a constant friction braking to said wheel to overcome inertia and to stop the continued rotation of said wheel when said motor device is not driving said wheel.

4. The device of claim 3, wherein said motor means comprises:

a continuously activated motor having a shaft;

a roller mounted on said shaft and operable to drive said wheel when in contact therewith for rotation;

a bell-crank lever motor mounting bracket mounting on one arm said motor;

a bell-crank bracket pivot parallel to the axis of said support tube and pivotally mounting said motor bracket with respect to said support tube; and, said control means comprises:

a mechanical rocking mechanism juxtaposed to the other arm of said motor bracket and operable to rock said bracket and said motor with respect to said wheel in response to said signal.

5. The device of claim 1 or 4, further comprising means to arrange a stocking disposed over said support tube with its free edge unsupported and extending beyond the mouth of said tubular support whereby the stocking may be conveniently held for movement to a sewing machine.

6. The device of claim 1 or 4, further comprising a tubular element disposed coaxially with and between said tubular support and said inverter tube and rotatable with respect to each, said tubular support including a slotted head having an end coplanar with the mouth of said inverter tube, and a pair of diametrically opposed radial slots extending from the end of said tubular element;

said inverter tube comprising a pair of diametrically opposed slots extending from the end of the mouth of said tube;

the alignment of said slots in said tubular element with said slots in said inverter tube providing a passage through which the stocking may be gripped for movement to a sewing machine, whereby the end of stocking need not be extended beyond said support tube to allow it to be gripped.

7. The device of claim 6 further comprising a radially extending lever secured to said tubular element whereby said tubular element can be rotated with respect to said inverter to move said slots into and out of alignment with each other.

* * * * *